US006619363B2

(12) United States Patent
Kröner et al.

(10) Patent No.: US 6,619,363 B2
(45) Date of Patent: Sep. 16, 2003

(54) ARTICULATED-ARM AWNING

(75) Inventors: Sven Kröner, Mettingen (DE); Bernhard Wessels, Rheine (DE); Justus Schmitz, Emsdetten (DE)

(73) Assignee: Schmitz-Werke GmbH + Co., Emsdetten (DE)

( * ) Notice: Subject to any disclaimer, the term of this patent is extended or adjusted under 35 U.S.C. 154(b) by 0 days.

(21) Appl. No.: 10/012,493

(22) Filed: Dec. 12, 2001

(65) Prior Publication Data

US 2002/0069975 A1 Jun. 13, 2002

(30) Foreign Application Priority Data

Dec. 12, 2000 (DE) ..... 100 61 819

(51) Int. Cl.[7] ..... E04F 10/06
(52) U.S. Cl. ..... 160/70; 160/79
(58) Field of Search ..... 160/66, 68, 69, 160/70, 71, 79; 135/88.11

(56) References Cited

U.S. PATENT DOCUMENTS 5,924,466 A 7/1999 Kroner et al.

FOREIGN PATENT DOCUMENTS

| | | | |
|---|---|---|---|
| DE | 1930945 | * | 1/1971 |
| DE | 2359132 | * | 6/1975 |
| EP | 0 593 389 A1 | | 10/1993 |
| FR | 2 516 577 | | 11/1981 |
| FR | 2 665 919 | | 8/1991 |
| FR | 2 682 713 | | 10/1991 |
| WO | WO 02/29176 A1 | * | 10/2000 |

* cited by examiner

*Primary Examiner*—Blair M. Johnson
(74) *Attorney, Agent, or Firm*—Browdy and Neimark, P.L.L.C.

(57) ABSTRACT

In an articulated-arm awning comprising two brackets for supporting the winding shaft and articulated arms, as well as a device for adjusting the slope of the articulated arms, also side faces disposed on both sides of the winding shaft, provision is made for the side faces to be fixed on the outside of the brackets, and for each articulated arm to be connected in an articulated fashion to the inside of one side face, and for the winding shaft to be supported on the brackets.

3 Claims, 2 Drawing Sheets

ARTICULATED-ARM AWNING

BACKGROUND OF THE INVENTION

1. Field of the Invention

The invention is directed to an articulated-arm awning comprising two holding brackets to support the winding shaft and articulated arms, as well as a device for adjusting the slope of the articulated arms, also side faces disposed on both sides of the winding shaft.

2. Background Art

Most articulated-arm awnings incorporate a so-called installation tube that extends parallel to the winding shaft at a distance from the same and to which the articulated arms and the device for adjusting the slope of the articulated arms are fixed.

On the other hand, designs without an installation tube are also known, wherein the articulated arms must be supported by different means.

SUMMARY OF THE INVENTION

The invention is based on the object of improving an articulated-arm awning of the above type in such a way that a compact and stable construction is attained along with a simple adjustability of the slope of the articulated arms.

This object is met according to the invention in such a way that the side faces are fixed to the outside of the brackets, each articulated arm is connected in an articulated fashion to the inside of one side face, and the winding shaft is supported on the brackets.

The side faces accordingly, on one hand, assume the conventional function of a side cover, which acts both as protection and also represents a decorative element. On the other hand, at the same time, it serves for mounting the articulated arms.

A further embodiment of the invention provides for the side faces to incorporate a support extension that is pivotably supported in a support cutout of the brackets in such a way that its final position is adjustable. A compact support means and adjustability of the angle are thus implemented at the same time.

To this extent, provision may be made in particular for the support extension to have a support section in the shape of a segment of a circle, and a recessed cam section that has a smaller curvature radius and a shoulder.

To adjust the slope, provision is made for the wall holder to furthermore comprise a threaded bore for at least one set screw, which is oriented such that the set screw sets under the above-mentioned shoulder of the cam section from below and locks the same in place in dependence upon its axial position.

To prevent a lifting by gusty winds, provision may be made for a second threaded bore to be provided approximately parallel to the first set screw for a second set screw that acts radially further inward on the cam section.

Provision may furthermore be made for the center longitudinal axis of the winding shaft to be flush with the center of the pivot support for adjusting the slope. This ensures that the position of the winding shaft remains unchanged regardless of the set slope.

The invention will be explained in more detail below based on a preferred embodiment in conjunction with the drawing.

DESCRIPTION OF THE PREFERRED EMBODIMENT

Figure 3:
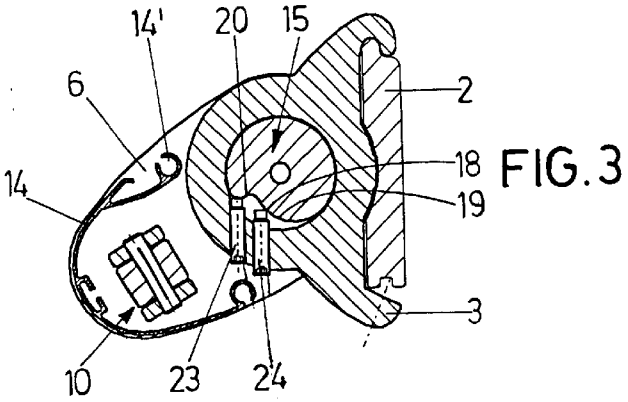
FIG. 3 shows an illustration corresponding to FIG. 2 with a changed slope setting of the articulated arms.

An articulated-arm awning 1 shown in the drawing comprises two wall holders 2, two brackets 3 placed thereupon in a form-fitting connection, and a winding shaft 4 that serves to wind up the awning cloth and is supported in manner so that it can rotate around the shaft axis 5.

Disposed on the outside of the brackets 3 are side faces 6, on the inside of which two articulated arms 10 comprising two articulated-arm sections 8, 9 are fastened via a fastening extension 7. The inner articulated arm section 8 is connected to the fastening extension 7 via a pivot hinge 11 and on the other hand to the outer articulated arm section 9 via a pivot hinge 12, and the outer articulated arm section 9, in turn, is again connected via a pivot hinge 13 to the drop-out profile 14. The awning cloth, which is not shown per se, is fixed to the latter via edge profile grooves 14'.

The side faces 6 have on their inside a support extension 15 that is pivotably supported in a corresponding round support cutout 16 of the holding brackets 3. The pivot center 5' of this support extension 15 is flush with the longitudinal axis 5 of the winding shaft.

The support extension 15 comprises a section 17 in the shape of a segment of a circle, and a cam section 18, with the cam section in turn comprising a curved section 19 with a smaller curvature radius than the circular segment-shaped support cutout 16, and a shoulder 20 that is formed in this manner.

The bracket 3 is provided with two parallel threaded bores 21, 22 extending at a distance from one another for set screws 23, 24, with the first set screw 23 ending in the region of the support extension 15 in such a way that it comes to rest below the shoulder 20 so that it supports the shoulder 20 from below and an axial shifting of this set screw 23 that serves to adjust the slope changes the angle position of the support extension 15 and thus also the angle position of the connected side face 6 and accordingly, in turn, also the angle position of the articulated arms 10 that are fixed to the side face 6. The second set screw 24 prevents the support extension 15 from being twisted in an upward direction, so that protection is also attained in this manner against a lifting by gusty winds, etc.

Figure 2:
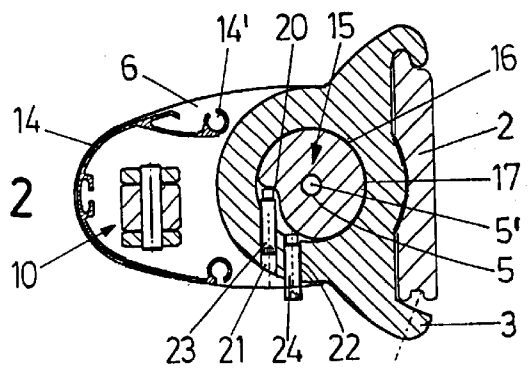
FIG. 2 shows a section along line II—II in FIG. 1.
Figure 1:
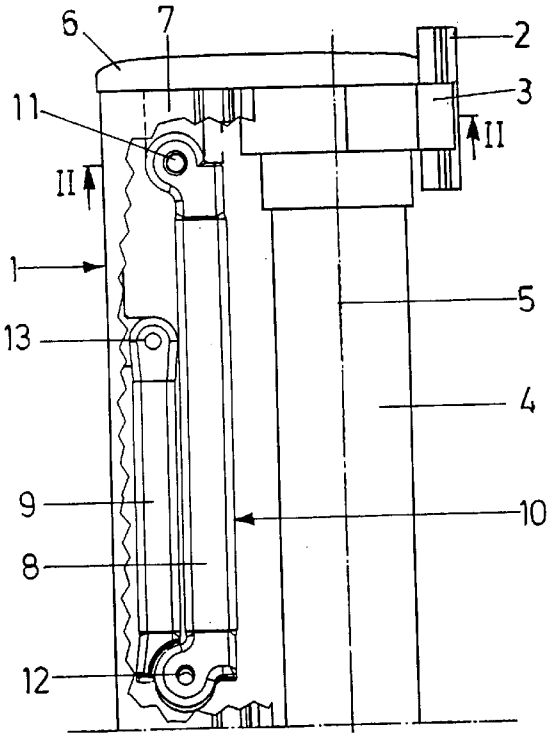
FIG. 1 shows a top view of an exterior region of an inventive articulated-arm awning.
Figure 4:
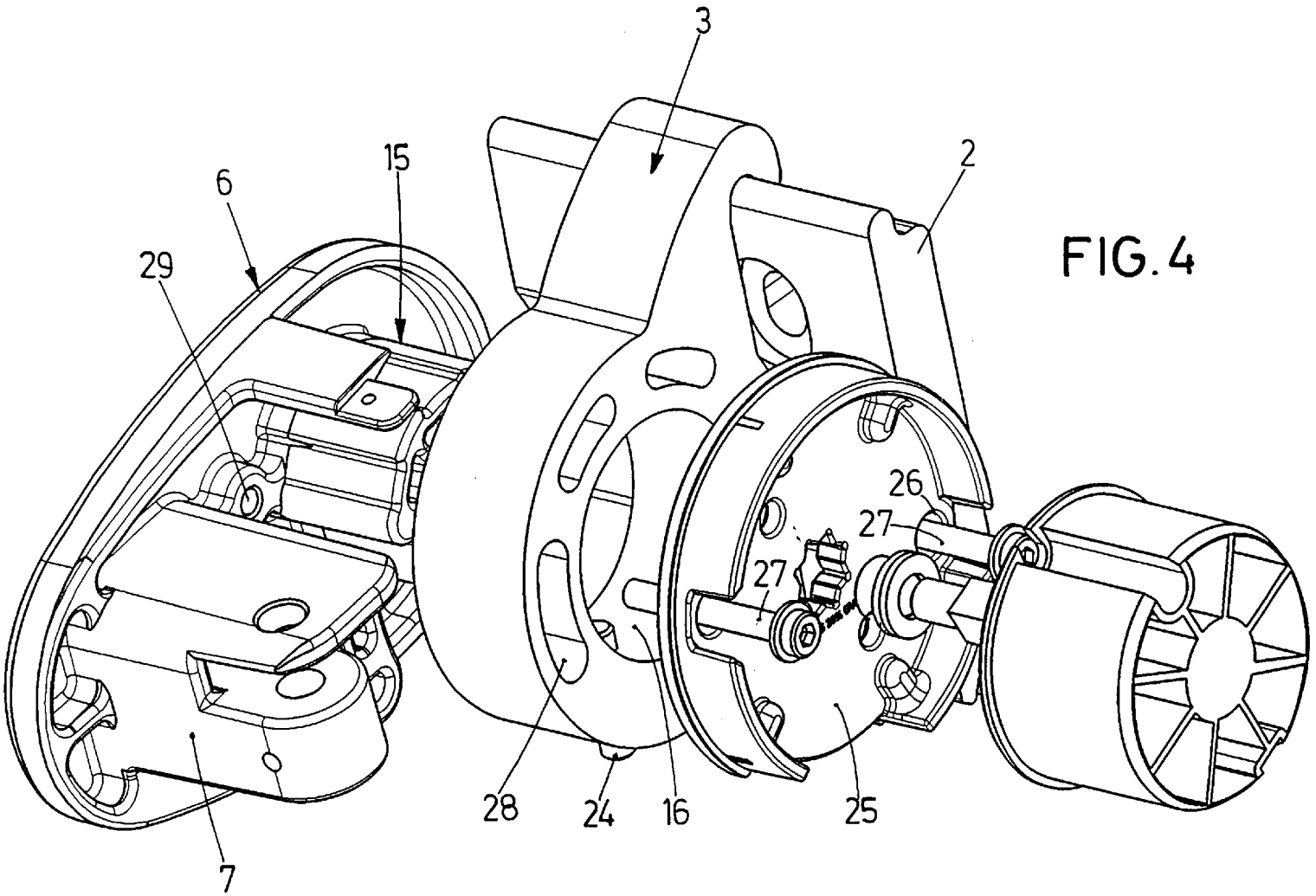
FIG. 4 shows an exploded view of the support region.

The comparison of FIGS. 2 and 3 clearly shows how changing the position of the set screw 23 and the set screw 24, respectively, permits the position of the articulated arms 10 and accordingly also of the drop-out profile 14 to be changed from a horizontal position, i.e., one with a slope of 0° shown in FIG. 2, to a position sloped by 30° shown in FIG. 3.

The side faces are fixed on the bracket 3 by means of a support cap 25 with borings 26 for fastening screws 27 that extend through long holes 28 of the bracket 3 and engage into threaded bores 29 on the inside of the side face 6. The support cap 25 serves to support the winding shaft 4.

What is claimed is:

1. An articulated-arm awning comprising two brackets (3) for supporting a winding shaft (4) and articulated arms (10), as well as a device for adjusting the slope of the articulated arms (10), also side faces (6) disposed on both sides of the winding shaft (4), wherein the side faces (6) are fixed on the outside of the brackets (3);

wherein each articulated arm (8,9) is connected in an articulated fashion to the inside of one side face (6);

wherein the winding shaft (4) is supported on the brackets (3);

wherein the slope adjusting device is such that the side faces (6) are adjustable in their slope relative to the brackets (3);

wherein the side faces (6) incorporate a support extension (15) that is pivotably supported in a support cutout (16) of the brackets (3) in a manner so that its final position is adjustable; and wherein the support extension (15) comprises a circular-segment shaped support section (17) and a recessed cam section (18) having a smaller curvature radius and a shoulder (20).

2. An articulated-arm awning according to claim 1, further comprising a wall holder (2) incorporating at least one threaded bore (21, 22) for at least one set screw (23, 24), which is oriented such that the set screw (23, 24) sets from below under the shoulder (20) of the cam section (18) and locks the same into place in dependence upon its axial position.

3. An articulated-arm awning according to claim 2, wherein a second threaded bore (22) for a second set screw (24) that acts radially further inward on the cam section (18) is provided approximately parallel to the first set screw (23).

* * * * *